US005712439A

United States Patent [19]

Toshifumi

[11] Patent Number: 5,712,439

[45] Date of Patent: Jan. 27, 1998

[54] MUSICAL TONE SIGNAL PRODUCING APPARATUS FOR SIMULATING THE EFFECT OF A VIBRATING ELEMENT OF A WIND INSTRUMENT

[75] Inventor: Kunimoto Toshifumi, Hamamatsu, Japan

[73] Assignee: Yamaha Corporation, Japan

[21] Appl. No.: 527,034

[22] Filed: Sep. 12, 1995

[30] Foreign Application Priority Data

Sep. 13, 1994 [JP] Japan ..... 6-219200

[51] Int. Cl.[6] ..... G10H 1/12

[52] U.S. Cl. ..... 84/661; 84/DIG. 9; 84/DIG. 10

[58] Field of Search ..... 84/661, DIG. 9, 84/DIG. 10, 622–625, 659, 660, 692–700, 735, 736

[56] References Cited

U.S. PATENT DOCUMENTS

| | | | |
|---|---|---|---|
| 5,223,656 | 6/1993 | Higashi | 84/661 |
| 5,241,127 | 8/1993 | Kobayashi | 84/661 X |
| 5,313,013 | 5/1994 | Suzuki et al. | 84/661 X |
| 5,359,146 | 10/1994 | Funaki et al. | 84/661 X |
| 5,403,969 | 4/1995 | Muto | 84/661 X |
| 5,496,964 | 3/1996 | Suzuki | 84/661 X |

FOREIGN PATENT DOCUMENTS

| | | |
|---|---|---|
| 5-232965 | 9/1993 | Japan . |
| 6-51766 | 2/1994 | Japan . |

*Primary Examiner*—Stanley J. Witkowski
*Attorney, Agent, or Firm*—Graham & James LLP

[57] ABSTRACT

A musical tone signal producing apparatus having a loop circuit portion including a filter circuit and a delay circuit for circulating therethrough a vibratory waveform signal to be produced as a musical tone signal and a control signal generator for generating a first control signal for effecting excitation of the waveform signal in the loop circuit and applying the first control signal to the filter circuit and for generating a second control signal for applying time variation to the waveform signal. The musical tone signal producing apparatus further includes a filter control circuit for modifying the second control signal based on the vibratory waveform signal and for applying a control parameter defined by the modified second control signal to the filter circuit for control of a signal transmission characteristic of the filter circuit.

10 Claims, 3 Drawing Sheets

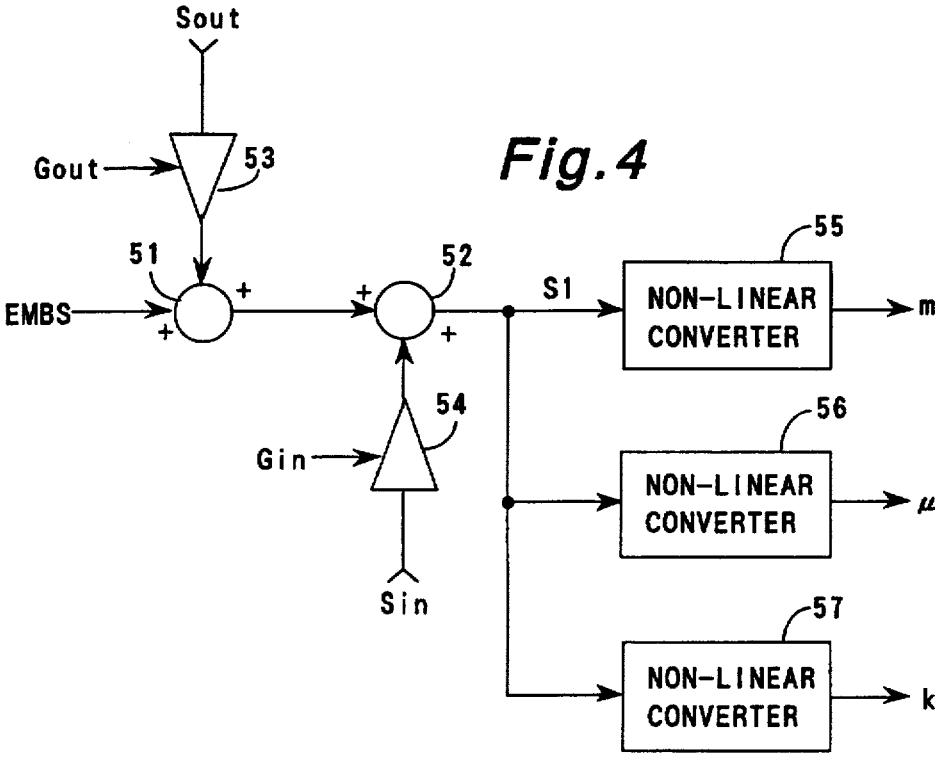
Fig.4
Fig.5A
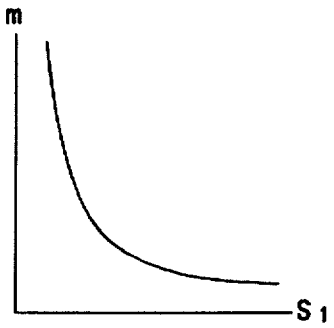
Fig.5B
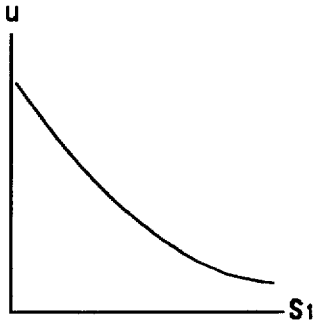
Fig.5C
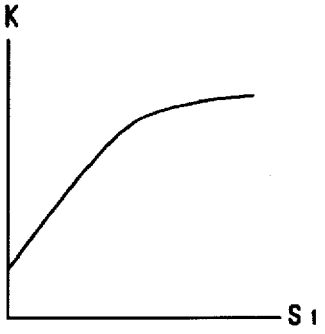

MUSICAL TONE SIGNAL PRODUCING APPARATUS FOR SIMULATING THE EFFECT OF A VIBRATING ELEMENT OF A WIND INSTRUMENT

BACKGROUND OF THE INVENTION

1. Field of the Invention

The present invention relates to a musical tone signal producing apparatus of the type which includes a loop circuit portion composed of a filter circuit and a delay circuit for circulating therethrough a vibratory waveform signal to be produced as a musical tone signal.

2. Description of the Prior Art

Disclosed in Japanese Patent Laid-open Publication No. 8(1994)-51766 is a musical tone signal producing apparatus of this kind which includes a loop circuit for circulating a vibratory waveform signal therein, a control signal generator for generating a first control signal for excitation of the waveform signal and a second control signal for applying time variation to the waveform signal, and a filter circuit provided in the loop portion to be applied with the first control signal for effecting excitation of the waveform signal and to be applied with the second control signal for changing a signal transmission characteristic thereof in accordance with variation of a control parameter represented by the second control signal. In the musical tone signal producing apparatus, the filter circuit acts to simulate a flow of air caused by vibration of a vibratory element such as a mouthpiece of a wind instrument, and the delay circuit acts to simulate a flow of air in a pipe portion of the wind instrument.

In such a conventional musical tone signal producing apparatus as described above, the signal transmission characteristic of the filter circuit is controlled only by the second control signal applied from the control signal generator, while vibration of the reed of the wood wind instrument or the mouthpiece of the brass wind instrument is influenced by posture or tightening of lips of the player and the flow of air in the wind instrument. However, a factor related to the flow of air in the wind instrument may not be represented by the second control signal. It is, therefore, unable to accurately simulate the flow of air caused by vibration of the vibratory element.

SUMMARY OF THE INVENTION

It is, therefore, a primary object of the present invention to provide an improved musical tone signal producing apparatus capable of accurately simulating the flow of air caused by vibration of the vibratory element.

According to the present invention, the object is accomplished by providing a musical tone signal producing apparatus having a loop circuit portion including a filter circuit and a delay circuit for circulating therethrough a vibratory waveform signal to be produced as a musical tone signal and a control signal generator for generating a first control signal for effecting excitation of the waveform signal in the loop circuit and applying the first control signal to the filter circuit and for generating a second control signal for applying time variation to the waveform signal, wherein the musical tone signal producing apparatus comprises a filter control circuit for modifying the second control signal based on the vibratory waveform signal and for applying a control parameter defined by the modified second control signal to the filter circuit for control of a signal transmission characteristic of the filter circuit.

According to an aspect of the present invention, the filter control circuit is arranged to modify the second control signal based on either one of input and output signals of said filter circuit.

According to another aspect of the present invention, the filter control circuit comprises a non-linear converter for converting the modified second control signal into a non-linear control signal for defining the control parameter.

BRIEF DESCRIPTION OF THE DRAWINGS

Other objects, features and advantages of the present invention will be more readily appreciated from the following detailed description of preferred embodiments thereof when taken together with the accompanying drawings, in which:

FIG. 4 is a block diagram of a filter control circuit shown in FIG. 1; and

FIGS. 5A–5C illustrate each conversion characteristic of non-linear converters shown in FIG. 4.

DESCRIPTION OF THE PREFERRED EMBODIMENT

Figure 1:
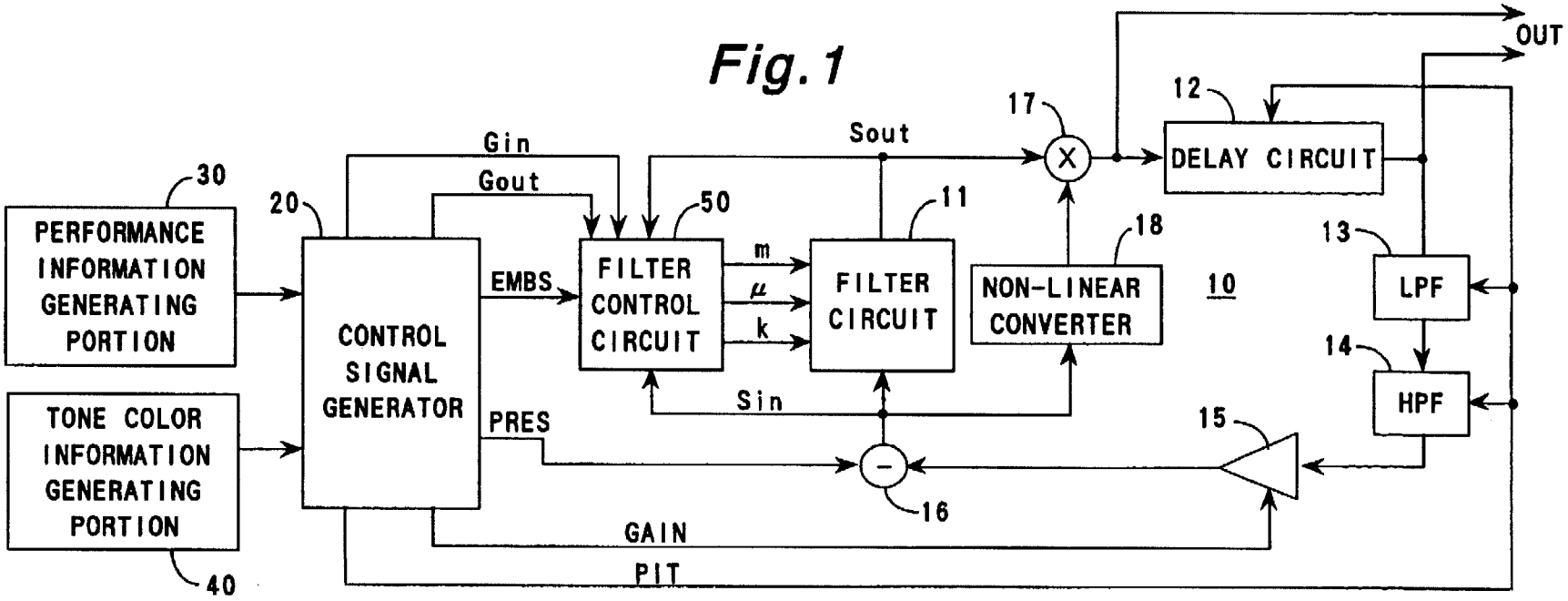
FIG. 1 is a block diagram of an electronic musical instrument provided with a musical tone signal producing apparatus in accordance with the present invention.

In FIG. 1 of the drawings, there is schematically illustrated an electronic musical instrument provided with a musical tone signal producing apparatus suitable for producing a musical tone signal simulated as a sound of a musical instrument such as a wood or brass wind instrument. The electronic musical instrument comprises a loop circuit portion 10 including a filter circuit 11, a delay circuit 12 and low-pass and high-pass filter circuits 13 and 14 for circulating a vibratory waveform signal therethrough and a control signal generator 20 for generating various kinds of control signals for the loop circuit portion 10. The filter circuit 11 is adapted to simulate a flow of air caused by vibration of a vibratory element such as a reed of a wood wind instrument, a mouthpiece of a brass wind instrument or the like. The delay circuit 12 and low-pass and high-pass filter circuits 13 and 14 are adapted to simulate a flow of air in a pipe portion of the wind instrument. The filter circuit 11 is applied with the vibratory waveform signal from the high-pass filter circuit 14 through a multiplier 15 and a subtracter 18. The multiplier 15 acts to control a feedback amount of the vibratory waveform signal in accordance with a control signal GAIN applied thereto from the control signal generator 20. The subtracter 16 is applied with a control signal PRES indicative of breath pressure from the control signal generating portion 20 and the vibratory waveform signal fed back through the multiplier 15 to subtract the control signal PRES from the vibratory waveform signal for applying the subtracted signal as an input signal Sin to the filter circuit 11.

Figure 2:
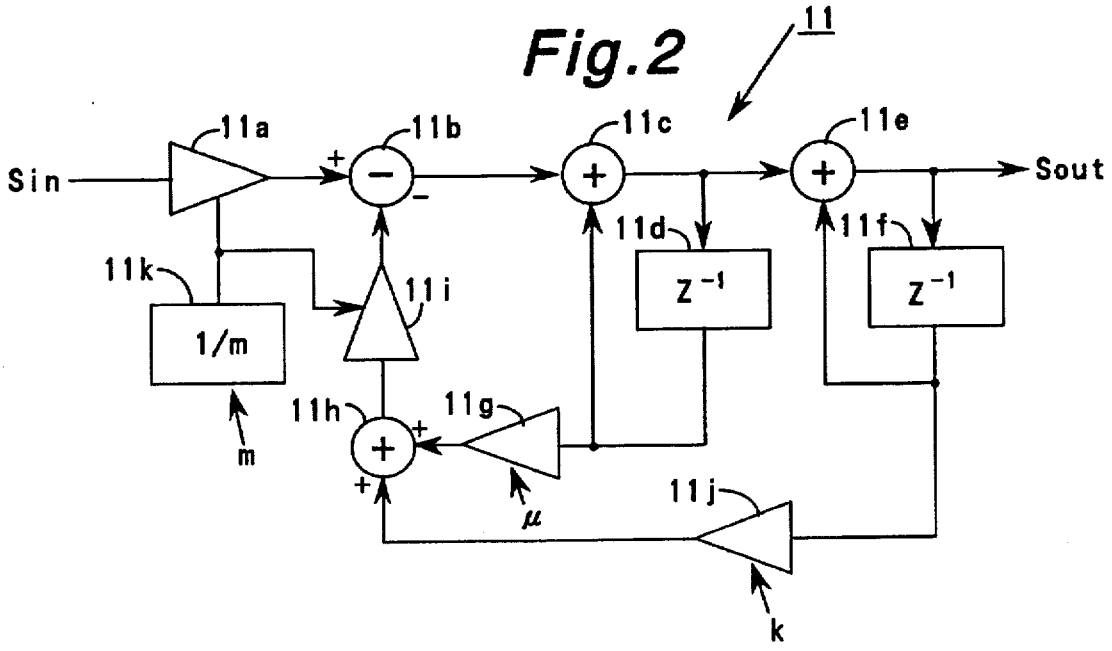
FIG. 2 is a block diagram of a filter circuit shown in FIG. 1.

As shown in FIG. 2, the filter circuit 11 includes a first integration circuit composed of a multiplier **11*a*, a subtracter 11*b*, an adder 11*c* and a delay circuit 11*d* and a second integration circuit composed of an adder 11*e* and a delay circuit 11*f*. In the filter circuit 11, the delay circuits 11*d* and 11*f* delay the input signal Sin with a sampling time to output the delayed input signal therefrom. An output of the first integration circuit is fed back to the subtracter 11b through a multiplier 11g, an adder 11h and a multiplier 11i, while an output of the second integration circuit is fed back to the subtracter 11b through a multiplier 11j, the adder 11h and multiplier 11i**.

The multipliers 11a and 11i are supplied with a control parameter 1/m representing a reciprocal of mass of the vibratory element of the wind instrument. Thus, the multipliers 11a and 11i multiply the input signal and the feedback signal respectively by a gain proportional to the control parameter 1/m to issue a signal indicative of each resultant of the multiplication. In this instance, the control parameter 1/m is calculated by a divider 11k on a basis of a control parameter m. The multiplier 11g is supplied with a control parameter μ representing an attentuation coefficient of the vibratory element to multiply the input signal by a gain proportional to the control parameter μ for producing a signal indicative of a resultant of the multiplication. The multiplier 11j is supplied with a control parameter k representing a spring constant of the vibratory element to multiply the input signal by a gain proportional to the control parameter k for producing a signal indicative of a resultant of the multiplication. The transfer function H(z) of filter circuit 11 is represented by the following equation (1), and the direct current gain G of filter 11 is represented by the following equation (2). The transfer function H(z) and direct current gain G are varied in accordance with the control parameters m, μ and k supplied to the filter circuit 11.

$$H(z) = \frac{1/m}{1 + (k/m + \mu/m - 2)Z^{-1} + (1 - \mu/m)Z^{-2}} \quad (1)$$

$$G = 1/k \quad (2)$$

Figure 3:
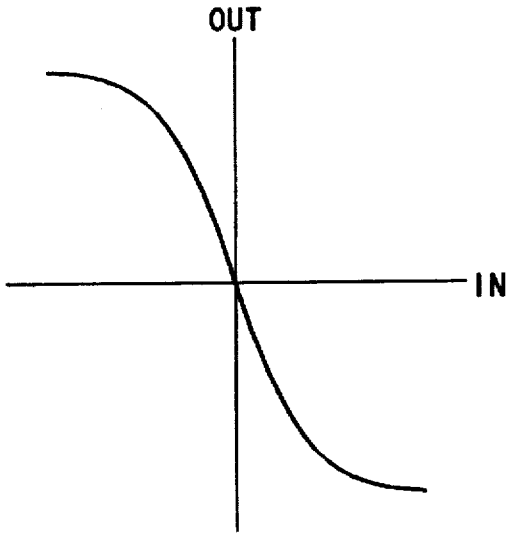
FIG. 3 is a graph showing a conversion characteristic of the non-linear converter shown in FIG. 1.

As shown in FIG. 1, the output of filter circuit 11 is connected to the input of delay circuit 12 through a multiplier 17 which is supplied with an output signal of a non-linear converter 18 to multiply an output signal Sout of filter circuit 11 by the output signal of the non-linear converter 18 for applying a signal indicative of a resultant of the multiplication to the delay circuit 12. The non-linear converter 18 is adapted to simulate the principle of Graham defining the fact that air pressure at a narrow tubular passage does not change in proportion to flow velocity of the air since the flow velocity is saturated by increase of the air pressure. When applied with the output signal Sin from the subtracter 16, the non-linear converter 18 converts the output signal Sin into a non-linear signal based on an input/output characteristic shown in FIG. 3 for applying the converted non-linear signal to the multiplier 17. The vibratory waveform signal is issued as a musical tone signal from the loop circuit portion 10 at the input and output sides of the delay circuit 12 and generated as a musical sound through a digital-to-analog or D/A converter, an amplifier and a loudspeaker (not shown). In a practical embodiment of the present invention, the output position of the musical tone signal may be selected at an appropriate position of the loop circuit portion 10.

A performance information generating portion 30 and a tone color information generating portion 40 are connected to the control signal generating portion 20. The performance information generating portion 30 includes a keyboard provided with a plurality of keys corresponding with a scale, a key detection circuit for detecting each depression of the keys, an initial-touch detection circuit for detecting operation velocity of a depressed key and an after-touch detection circuit for detecting pressure and depth of the depressed key. The tone color information generating portion 40 includes a tone color selection switch and a detection circuit for detecting operation of the selection key. The control signal generator 20 is in the form of a microcomputer or a control parameter memory table which is adapted to produce various kinds of control signals in accordance with performance information and tone color information respectively detected by the foregoing detection circuits.

The control signals are determined by depression of a key on the keyboard, initial-touch performance information and after-touch information of the depressed key and tone color information from tone color information generating portion 40. The control signals are composed of control signals PIT, PRES, EMBS respectively indicative of pitch of a musical tone to be produced, breath pressure and embouchure of the wind instrument such as posture and tightening of lips and control signals GAIN, Gin, Gout indicative of various gains. The control signal PIT is applied to the delay circuit 12 and low-pass and high-pass filter circuits 13 and 14. The delay circuit 12 delays an input vibratory waveform signal with a time defined by the control signal PIT to determine pitch of the vibratory waveform signal. The filter circuits 13 and 14 permit only the vibratory waveform signal passing therethrough at a frequency band defined by the control signal PIT. The control signal PRES is supplied to the input of filter circuit 11 through the subtracter 16 to excite the vibratory waveform signal circulating in the loop circuit portion 10. The control signal EMBS is supplied to the filter control circuit 50 to apply time variation to the vibratory waveform signal. The control signal GAIN is supplied to the multiplier 15 for gain control of the feedback waveform signal, and the control signals Gin, Gout are supplied to the filter control circuit 50 for gain control of the input signal applied thereto from the subtracter 16.

In the case that a mouth controller with a sensor for detection of breath pressure is connected to the electronic musical instrument of the present invention, the mouth controller may be adapted to provide a portion of the performance information. In the case that the present invention is adapted to an electronic wind instrument, a performance portion of the wind instrument may be adapted to provide the various kinds of performance information data. In addition, another musical instrument, an automatic performance apparatus or the like may be adapted as the performance information generating portion 30 and tone color information generating portion 40 to supply the performance information and tone color information to the control signal generator 20. Alternatively, the various kinds of control signals may be formed in the automatic performance apparatus to be directly supplied to the filter control portion 50 and loop circuit portion 10.

As shown in FIG. 4, tho filter control circuit 50 includes adders 51 and 52 which are provided to mix the input signal Sin and output signal Sout of the filter circuit 11 with the control signal EMBS supplied thereto from the control signal generator 20. The adder 51 is arranged to add the control signal EMBS to the output signal Sout supplied thereto from the filter circuit 11 through a multiplier 53, and the adder 52 is arranged add an input signal indicative of a resultant of the addition at the adder 51 to the input signal Sin supplied thereto from the subtracter 18 through a multiplier 54 thereby to apply an input signal $S_1$ indicative of a resultant of the addition to non-linear converters 55–57. The multiplier 53 acts to multiply the output signal Sout of the filter circuit 11 by the control signal Gout supplied thereto from the control signal generator 20, while the multiplier 54 acts to multiply the input signal Sin by the control signal Gin supplied from the control signal generator 20.

The non-linear converters 55–57 convert the input signal $S_1$ into non-linear output signals in accordance with conversion characteristics respectively shown in FIGS. 5A–5C. As a result, a control parameter representing the mass "m" of the vibratory element decreases in accordance with an increase of the input signal $S_1$. This simulates the fact that the vibration portion of the vibratory element becomes small as tightening of lips is increased or the flow velocity (or pressure) of air is increased. Similarly, a control parameter representing the attenuation coefficient "μ" of the vibratory element decreases in accordance with an increase of the input signal $S_1$. This simulates the fact that attenuation of vibration of the vibration element becomes small as tightening of lips is increased or the flow velocity (or pressure) of air is increased. A control parameter representing the spring constant "k" of the vibratory element increases in accordance with an increase of the input signal $S_1$. This simulates the fact that the vibratory element becomes stiff as tightening of lips is increased or the flow velocity (or pressure) of air is increased. In this case, the output signal Sout of the filter circuit 11 is applied to the filter control circuit 50 for taking into consideration an influence of the flow air in the wind instrument to vibration of the vibratory element, while the input signal Sin from the subtracter 16 is applied to the filter control circuit 50 to prevent the vibratory waveform signal from unusual oscillation caused by input of the output signal Sout.

Assuming that the control signal generator 20 is supplied with various kinds of performance information data and tone color information data respectively from the performance information generating portion 30 and tone color information portion 40 in operation of the electronic musical instrument, the control signal generator 20 produces various kinds of control signals PRES, PIT, GAIN, EMBS, Gin, Gout based on the supplied information data. The control signal PRES is applied to the filter circuit 11 through the subtracter 18 to excite a vibratory waveform signal in the loop circuit portion 10. The excited vibratory waveform signal is fed back to the subtracter 16 through the multiplier 15 in accordance with an amount of the control signal GAIN, and in turn, the fed back vibratory waveform signal and the control signal PRES cause vibratory waveform signal to circulate in the loop circuit portion 10. During circulation of the vibratory waveform signal, the delay circuit 12 delays the vibratory waveform signal with a time defined by the control signal PIT, and the low-pass and high-pass filters 13 and 14 control a pass-band of the waveform signal in accordance with the control signal PIT. Thus, a frequency of the vibratory waveform signal circulating in the loop circuit portion 10 is controlled in accordance with the control signal PIT so that a musical tone signal of zone pitch designated by the performance information generating portion 30 is produced from the loop circuit portion 10.

During production of the musical tone signal, the filter control circuit 50 is applied with the control signals EMBS, Gin, Gout and the vibratory waveform signals Sin, Sout respectively from the control signal generator 20 and the loop circuit portion 10. Thus, the filter control circuit 50 adds the control signal EMBS to the vibratory waveform signals Sin, Sout controlled by the control signals Gin, Gout and supplies a signal indicative of a resultant of the addition as an input signal $S_1$ to the non-linear converters 55–57. The input signal $S_1$ is converted by the non-linear converters 55–57 respectively on a basis of the conversion characteristics shown in FIGS. 5A–5C and applied as control parameters m, μ, k to the filter circuit 11. As a result, the signal transmission characteristic of filter circuit 11 is determined by the control parameters m, μ, k and varies in response to the control signal EMBS and vibratory waveform signals Sin, Sout. Since the vibratory waveform signal circulating in the loop circuit portion 10 is varied by the signal transmission characteristic of filter circuit 11, the circulating vibratory waveform signal will change in response to the control signal EMBS and the vibratory waveform signals Sin, Sout.

As is understood from the above description, the signal transmission characteristic of filter circuit 31 is controlled by the control parameters m, μ, k supplied from the filter control circuit 50, and the control parameters m, μ, k are provided by non-linear conversion of the input signal $S_1$ formed by addition of the vibratory waveform signals Sin, Sout circulating in the loop circuit portion 10 to the control signal EMBS. Accordingly, the filter circuit 11 acts to simulate the flow of air caused by vibration of the vibratory element at the excitation portion of the wind instrument thereby to effect time variation of the vibratory waveform signal circulating in the loop circuit portion 10 in accordance with the flow of air in the wind instrument.

Although in the above embodiment, the non-linear converters 55–57 each have been composed of a non-linear table, progression calculation of the following formula may be adapted to apply a desired non-linear characteristic to the input signal $S_1$.

$$a_0+a_1S_1+a_2S_1^2+\ldots+a_nS_n^n$$

In this formula, the coefficients $a_1, a_2, \ldots a_n$ each are a predetermined constant or a variable applied from the control signal generator 20.

Although in the above embodiment, the non-linear converters 55–57 each are composed of a single non-linear table, each of the non-linear converters 55–57 may be composed of a plurality of non-linear tables to be switched over in accordance with performance information data such as tone pitch, an initial-touch and an after-touch of a depressed key or the like. Alternatively, each of the non-linear converters 55–57 may be composed of a combination of a non-linear table and an operation unit. In such a modification, the operation unit is arranged to add the control signals PRES, EMBS, PIT to an input or output signal of the non-linear table or to multiply the control signals by the input or output signal of the non-linear table.

In a modification of the embodiment, the filter circuit 11 shown in FIG. 2 may be replaced with a digital filter of appropriate degrees. Although in the above embodiment, control signal PRES is continuously applied to the filter circuit 11 through the subtracter 16 for exciting the vibratory waveform signal, the control signal PRES may be applied as an impulse signal or a burst signal to the filter circuit 11 only when the musical tone is produced. In this case, it is required to set the control signal GAIN as a relatively large value.

Although in the above embodiment, the low-pass and high-pass filters 13 and 14 are provided to determine a propagation characteristic of the flow of air in the pipe portion of the wind instrument, either one of the filters may be provided or another filter may be substituted for the filters 13 and 14.

Although in the above embodiment, the musical tone signal forming portion is composed of hard circuits in the form of the filter circuit 11, delay circuit 12, low-pass and high-pass filters 13 and 14, multipliers 15, 17, subtracter 16, non-linear converter 18 and filter control circuit 50, a portion or the entirety of the hard circuits may be replaced with a computer circuit or a general purpose digital signal processing unit for effecting the equivalent function to the hard circuits based on program processing. Although the above embodiment has been adapted to produce a wood or brass wind instrument tone, the present invention may be adapted to produce a stringed instrument tone, a piano tone or the like or to synthesize novel musical instrument tones.

What is claimed is:

1. A musical tone signal producing apparatus having a loop circuit portion including a filter circuit and a delay circuit for circulating therethrough a vibratory waveform signal to be produced as a musical tone signal and a control signal generator for generating a first control signal for effecting excitation of the waveform signal in said loop circuit and applying the first control signal to said filter circuit and for generating a second control signal for applying time variation to the waveform signal, wherein the musical tone signal producing apparatus comprises a filter control circuit for modifying the second control signal based on the vibratory waveform signal and for applying a control parameter defined by the modified second control signal to said filter circuit for control of a signal transmission characteristic of said filter circuit.

2. A musical tone signal producing apparatus as recited in claim 1, wherein said filter control circuit is arranged to modify the second control signal based on either one of input and output signals of said filter circuit.

3. A musical tone signal producing apparatus as recited in claim 1, wherein said filter control circuit is arranged to modify the second control signal based on input and output signals of said filter circuit.

4. A musical tone signal producing apparatus as recited in claim 1, wherein said filter control circuit comprises a non-linear converter for converting the modified second control signal into a non-linear control signal for defining the control parameter.

5. A musical tone signal producing apparatus as recited in claim 1, wherein said filter circuit is adapted to simulate a flow of air caused by vibration of a vibratory element such as a reed of a wood wind instrument or a mouthpiece of a brass wind instrument.

6. A musical tone signal producing apparatus including:

first means for circulating a vibratory waveform signal to be produced as a musical tone signal;

second means for generating a first control signal for effecting excitation of the waveform signal and applying the first control signal to said first means and for generating a second control signal for applying time variation to the waveform signal, and third means for modifying the second control signal based on the vibratory waveform signal and for applying a control parameter defined by the modified second control signal to said first means for control of a signal transmission characteristic of said first means.

7. A musical tone signal producing apparatus as recited in claim 6, wherein said third means is arranged to modify the second control signal based on either one of input and output signals of said first means.

8. A musical tone signal producing apparatus as recited in claim 6, wherein said third means is arranged to modify the second control signal based on input and output signals of said first means.

9. A musical tone signal producing apparatus as recited in claim 6, wherein said third means comprises means for converting the modified second control signal into a non-linear control signal for defining the control parameter.

10. A musical tone signal producing apparatus as recited in claim 6, wherein said first means is adapted to simulate a flow of air caused by vibration of a vibratory element.

* * * * *